United States Patent [19]

Eriksson

[11] Patent Number: 4,612,727

[45] Date of Patent: Sep. 23, 1986

[54] WINDOWS

[76] Inventor: Lars Eriksson, Storgatan 40, S-361 00 Emmaboda, Sweden

[21] Appl. No.: 606,295

[22] Filed: May 2, 1984

[30] Foreign Application Priority Data

May 27, 1983 [SE] Sweden ..... 8302994

[51] Int. Cl.[4] ..... E05B 65/04

[52] U.S. Cl. ..... 49/62; 49/65

[58] Field of Search ..... 49/61, 62, 63, 65, 67, 49/163, 168, 250, 252

[56] References Cited

U.S. PATENT DOCUMENTS

| | | | |
|---|---|---|---|
| 2,186,270 | 1/1940 | Persson | 49/62 |
| 2,316,442 | 4/1943 | Lootens | 49/62 |
| 2,419,524 | 4/1947 | Albano | 49/252 |
| 2,921,350 | 1/1960 | Kelly | 49/65 X |
| 3,122,799 | 3/1964 | Lunde | 49/252 X |

*Primary Examiner*—Kenneth Downey

*Attorney, Agent, or Firm*—Burns, Doane, Swecker & Mathis

[57] ABSTRACT

The disclosure relates to opening window, door or the like comprising a frame (1, 2), a casement (3, 4) and an exteriorly disposed protective cladding (7).

The invention is designed to offer such a simple solution to the suspension of the casement and the mounting of the protective cladding as also permits that the casement may be pivoted so that its outside will be interiorly accessible.

The window has at least one portion of the protective cladding (7) designed as a retainer unit which is pivotal and is fixedly retained in the frame (1, 2) by means of hinges (9). The casement (3, 4) is connected to the retaining unit by means of second hinges (10). The window is further provided with releasable locking devices (11) on the casement and the retaining unit, or grooves (13, 14) in the frame and a corresponding pin on the casement so as to hold together the casement and retaining unit whereby these, on normal opening and closing, are pivotal together as one unit while the casement, in certain positions, may be swung out away from the retaining unit and turned with its outside facing inwardly.

7 Claims, 4 Drawing Figures

WINDOWS

TECHNICAL FIELD

The present invention relates to an opening window, door or the like which is provided, on its outside, with a protective cladding, preferably of metal, and is designed in such a manner that it may be turned so that the outside will be interiorly accessible, for example, for cleaning.

THE STATE OF THE ART

In the art, there are previously known windows which are pivotal in such a manner that the outer face of the window may be accessible from the interior of the room, for example, in conjunction with window cleaning. As examples of windows of this type, mention might be made of different types of pivot hung windows, for example the so-called perspective window, as well as a window which is normally called the H-window. In these prior art window types, the pivotal facility must be purchased at the price of complicated fittings, and, as far as certain types of pivot hung windows are concerned, also at the price of serious problems in sealing.

It has also become steadily more common in the art to provide the exterior of wooden windows, doors or the like with protective cladding, this cladding consisting of sheet metal profiles, extruded aluminum profiles, plastic or the like. Such protective claddings are often complex and difficult to apply and have never possessed any other function than that of protection alone.

OBJECT OF THE INVENTION

The object of the present invention is to realize a window, door or the like, which, in the open state, is turnable so that its outside will become accessible from the inside of the room and which is moreover provided with extremely simple protective cladding forming part of the construction as an integrated component.

SOLUTION

This object is achieved according to the present invention by means of a window, door or the like which comprises a frame and casement and an exteriorly disposed protective cladding, and being characterised in that the protective cladding comprises a pivotal portion which, by means of a first joint member, is pivotally fixed in the frame; and that the casement is fixable in the pivotal portion of the protective cladding so that the casement and the pivotal portion, on opening of the window, or door, are pivotal together by means of the first joint member.

In one practical embodiment of the present invention, the casement is suitably pivotally retained in the pivotal portion by means of a second joint member which is placed on that side of the pivotal portion facing away from the first joint member, the window or door being provided with means by which the casement and the pivotal portion are releasably retainable against one another so that, on opening and closing of the window or door, they are pivotal together as a unit and pivotal away from one another in the open position of the window or door.

In particular in cases of small and light windows, the subject matter of the present invention may further be characterised in that the casement and pivotal portion are provided with mutually cooperating locking devices for releasable interconnection of the casement and the pivotal portion.

If the window, or door, is of larger and heavier design, it may, to avoid uneven loading or overloading of the pivotal cladding, be suitable to support one corner of the casement against the sill or frame bottom, at least when the casement is swung out away from the pivotal portion. In such a case, the invention is suitably further characterised in that the frame is provided with a groove in which a projection disposed on the casement engages, the groove being designed to retain the casement and the pivotal portion against one another apart from at certain pivotal positions of the pivotal portion in which the casement may be pivoted away therefrom.

The invention may also be applied to such windows in which the casement consists of two mutually pivotal casement members, i.e. in which the window is of the double-coupled type. In such a situation, the present invention calls for the suitable interconnection of the casement members by means of a third member which is located on the same side of the casement as the second joint member.

In such situations where larger areas of the outwardly facing surface of the window frame are freely exposed outwardly, the invention may be embodied in a particularly simple manner, it then applying that the pivotal portion of the protective cladding be arranged to cover the outwardly facing side of the window casement and at least the greater portion of the outwardly facing side of the window frame.

In such situations where the outwardly facing side of the window frame is only partly freely exposed outwardly, or where, for some reason - perhaps for aesthetic reasons - it is desired to provide separate protective cladding on the window frame, the present invention suitably calls for the arrangement that the protective cladding comprise one portion which substantially covers the outside of the window frame and is immovably fixed therein, and the pivotal portion which substantially covers the outside of the window casement.

BRIEF DESCRIPTION OF THE ACCOMPANYING DRAWINGS

The present invention will now be described in greater detail below, with reference to the accompanying Drawings which, by way of exemplification, schematically illustrate simplified cross-sections through a window.

In the accompanying Drawings:

FIG. 3 shows the window in the open position in which the casement has been turned such that its outside is accessible, for example, for cleaning. These Drawings could also just as well refer to a door or the like.

DESCRIPTION OF PREFERRED EMBODIMENT

Figure 1:
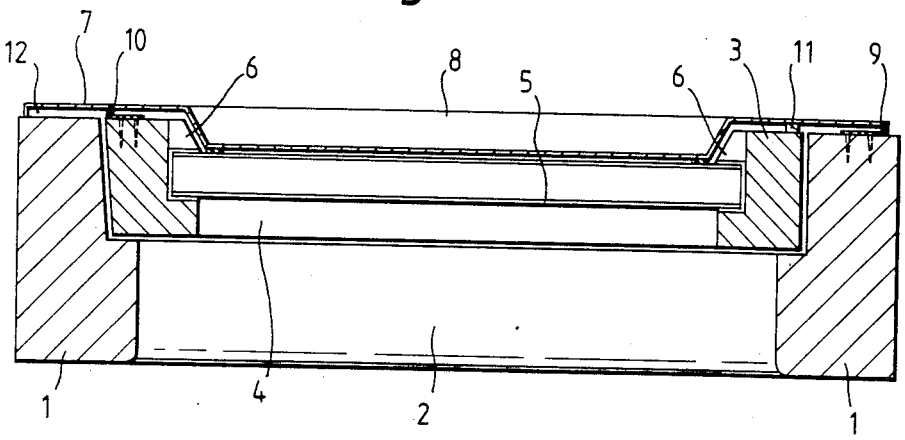
FIG. 1 shows the window in the fully closed position.

Referring to the Drawings, FIG. 1 shows, under reference numeral 1, the two vertical jambs of a window frame, while the sill is designated 2. In the window frame, there is disposed a casement whose stiles are designated 3, while the bottom rail is designated 4. In the casement, there is disposed a glazing unit, for example a so-called sealed insulating glass unit 5, which is retained in the casement by some form of suitable glazing bead 6. The detailed construction of the window casement is of no particular consequence according to the present invention, for which reason no detailed description of, for example, the anchorage and appearance of the glazing unit 5 will be provided. Furthermore, the glazing beads and the like which are normally present in a window will be omitted, for purposes of clarity.

According to the present invention, the window has, on its outside, a protective cladding 7 which may suitably be manufactured of metal, reinforced or non-reinforced plastic or even compression moulded plywood, and which, in the embodiment illustrated on the Drawings, covers both the casement and greater portion of the frame. In order, in an aesthetically attractive manner, to connect to the glazing unit 5, the cladding 7 has a portion 8 directed inwardly towards the glazing unit and which may possibly be provided with a sealing bead on its edge turned to face the glass so that rainwater and the like is thereby prevented from running down between the cladding and the casement. The inwardly directed portion 8 is also of great importance, since it rigidifies the cladding.

According to the present invention, the protective cladding is suitably provided, along its one vertical edge, with a number of hinges or joint members 9 by means of which the cladding is pivotally anchored to the outside of the window frame. According to the invention, the casement is not in direct communication with the frame, but is, instead, fixedly retained, by means of a second hinge or joint member 10, to the inside of the protective cladding, so that the casement is thereby hung in the protective cladding. Suitably, the casement and protective cladding may, on their side turned to face away from the hinge 10, be provided with locking means 11, possibly designed as a snap-lock and which interlocks the protective cladding and the corresponding portion of the casement, so that these are held in a secure position in relation to one another. Hereby, the casement and the protective cladding may be considered as a coherent unit when the lock 11 is in its operative position.

On opening of the window according to the present invention, one hinge which connects the casement proper to the frame will be superfluous in that the unit comprising the cladding 7 and the casement is hung in the frame by means of the hinges 9 and is also opened by means of these. It will be clearly apparent from FIG. 2 how such an opening operation is carried out.

As was mentioned above, the casement is connected to the protective cladding 7 by means of a second joint member or hinge 10 which is fixed in that stile 3 of the casement which is located most distal from the joint member 9 interconnecting the cladding and the window frame. This entails that when the window has been opened a sufficient distance and moreover, the locking device 11 has been opened, the casement may be pivoted away from the protective cladding (see FIG. 3) so that thereby the outside of the window will be interiorly accessible, for example for cleaning. To prevent uneven or inclined loading of the protective cladding, the casement may suitably be provided, in its lower corner, turned to face the first joint member 9, with a pin which slides in the groove 14 in the frame when the casement is swung out from the protective cladding.

Figure 2:
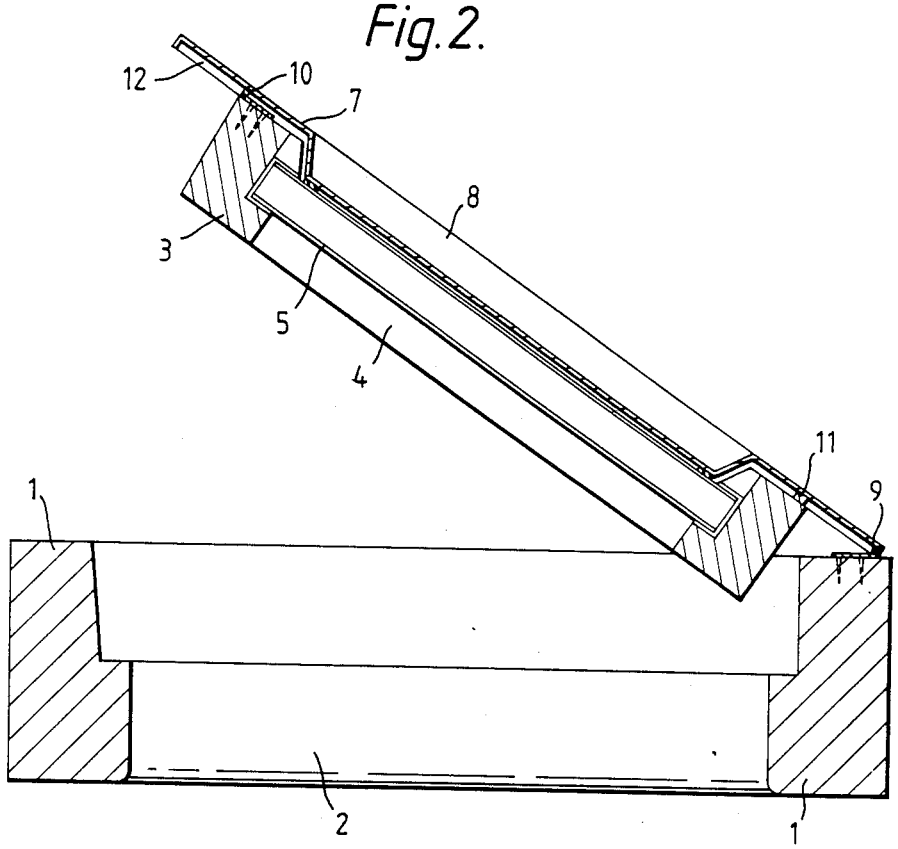
FIG. 2 shows the window in the open position at normal opening state.
Figure 3:
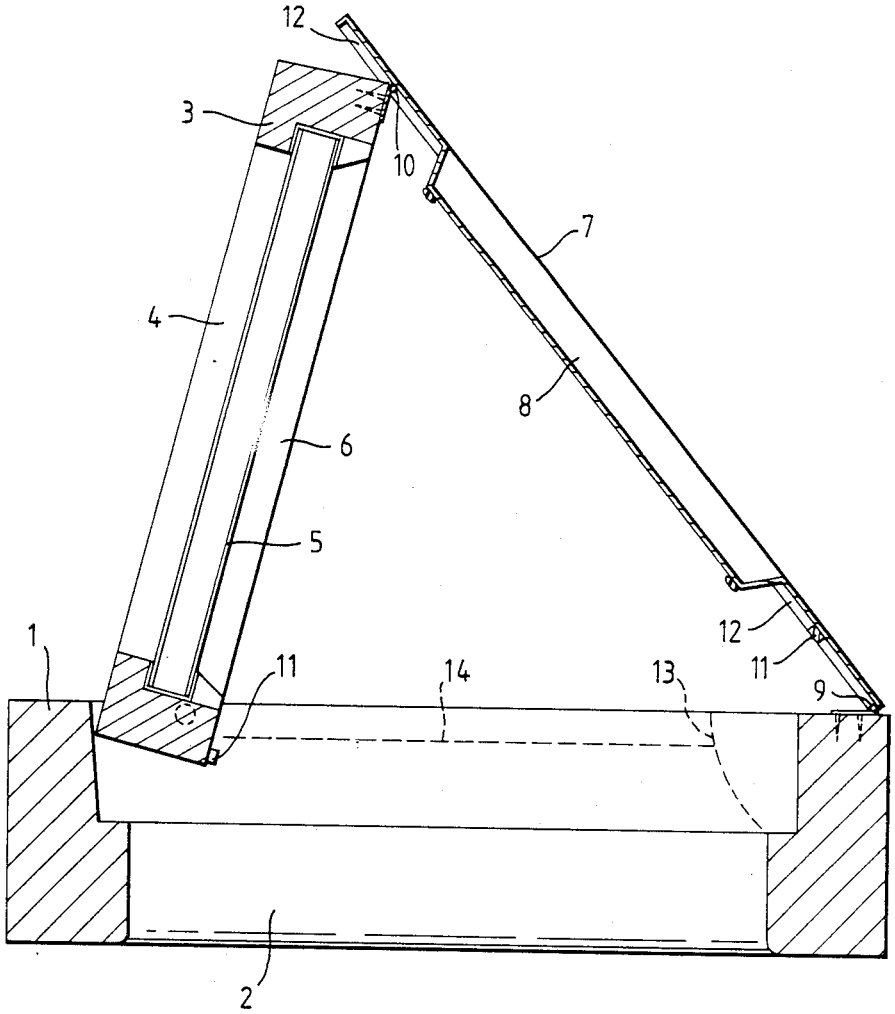
Figure 4:
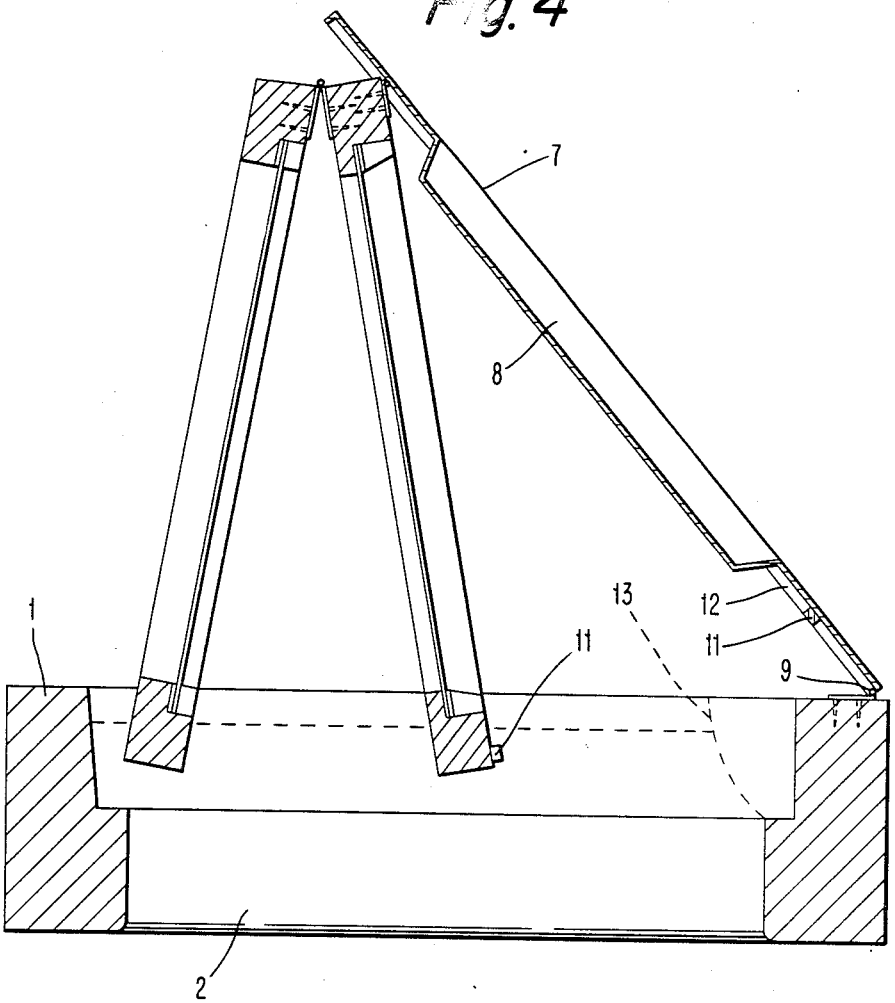
FIG. 4 is a view similar to FIG. 3 showing a further embodiment of the present invention in which the casement includes two part-casement members.

In the embodiment illustrated in FIGS. 1–3, the casement is designed as a single unit and is provided with a sealed insulating glass unit. However, according to the present invention, there is nothing to prevent the casement from being composed of two part-casements in which each part-casement may be provided with one or more glass panes (double coupled windows). When the casement is designed in this manner (FIG. 4), both of the part-casements are interconnected by means of hinges or joints which are disposed at one of the vertical stiles of the casement. According to the present invention, these hinges which interconnect the part-casements should be placed at the same edge of the casement as the joint member 10 interconnecting the casement with the cladding 7. With such a construction, it will be possible to open the window and thereafter pivot the two part-casements away from one another so that, in principle, all of the glass pane surfaces included in the window may be interiorly accessible, for example, for cleaning.

In the embodiment illustrated on the Drawings, the cladding 7 is of such width as to cover not only the outside of the casement but also the outside of the window frame itself. However, in certain cases, this may be unsuitable, for example if the window frame has been mounted in such a manner that its entire outside is not freely exposed outwardly. According to the present invention, it is then possible to design the cladding in such a manner as to cover only the casement; in such a case the cladding having the joint member 9 placed in the region between the casement and the frame and not, as shown on the Drawings, at the outside of the window frame. In this embodiment, use is suitably made of separate protective panels on the outside of the window frame and these panels may, naturally, be permanently mounted on the window frame.

According to the invention, it is also possible to design the cladding in such a way as to cover the entire outside of the casement and, moreover, also a certain portion of the outside of the frame. Naturally, combinations are possible in which the cladding may, for example, cover the jamb but not the frame head and sill, or vice versa.

The fact that the protective cladding 7 is used as support fittings for the entire casement and the glazing unit included therein entails that certain demands must be placed on its strength. Thus, the cladding 7 may very well be manufactured in one piece by punching or pressing from suitable sheet metal materials, or be laminated or compression moulded in plastic or plywood. Nevertheless, it is possible to join together the cladding 7 from a basis of profile materials, in which, joints would be realised in the corner regions for the cladding. In such cases where particularly high demands on strength are placed, the cladding may also include tubular, or otherwise designed closed or opened profile members which, together with, or instead of the inwardly directed portions 8, rigidify the cladding and generally increase its strength. Furthermore, the protective cladding may, for reasons both of strength and of aesthetic appearance, be provided along its outer edges with a flange 12 directed towards the window frame or casement.

In particular in such cases when the windows are large, it may, as has been intimated above, be suitable to provide the lower corner of the casement at the joint member 9, with a downwardly directed pin which runs in a corresponding groove (shown by broken line 13 in FIG. 3) in the window frame. Such a groove will describe a circular arc with the central axis of the joint member 9 as its centre so as to permit normal opening and closing of the window.

When the window is to be swung up to the cleaning position according to FIG. 3, the pin disposed on the underside of the casement will slide in a longitudinal groove in the lower portion 2 of the frame, this groove being shown by the broken line 14 in FIG. 3. The arrangement of this groove 14 prevents the casement from becoming detached from the frame when the casement is swung outwardly from the cladding, whereby the window frame may take up a large portion of the weight of the casement. This avoids uneven loading of the cladding so that this may be given slighter dimensions.

The curved groove 13 may also be given the function of a locking device between the casement and the pivotal portion so that these are prevented from swinging away from one another during the greater travel of a normal opening and closing movement of the window. Possibly, the action of the groove may be supplemented by mutually cooperating sleeves and pins on the casement and the pivotal portion.

Above, the invention has been described, for purposes of exemplification, in the form of a window which is pivotal about a vertical pivotal axis, the illustrated sectional view being taken horizontally. Naturally, the invention may equally advantageously be applied to a window, door, hatch, skylight or the like which is supported, for example, in its upper or lower edge, and which, thus, is pivotal about a horizontal pivoting axis. In such a situation, that mentioned above concerning the jambs and stiles of the frame and casement should naturally relate to the upper and lower pieces thereof.

Apart from the above-intimated modifications of the present invention, situations are conceivable in which the pivoting axes of the cladding in relation to the frame and of the cladding in relation to the casement are not parallel but are disposed along sides of the casement making angles with one another.

I claim:

1. A window comprising a frame member; a casement member; an exteriorly disposed structural pivotal member; first pivot means connecting an edge portion of said pivotal member to said frame member; second pivot means connecting an opposite edge portion of said pivotal member to an adjacent edge portion of said casement member; said pivotal member being a protective cladding covering at least an exterior side of said casement member; said protective cladding and said casement member having, at their side edges adjacent said first pivot means, cooperating locking means to selectively lock the cladding and the casement member together to pivot as a rigid unit about said first pivot means and to pivot away from each other about said second pivot means when said protective cladding is pivoted away from said frame member, whereby said casement member may be pivoted to a position where an exterior side thereof is accessible from a location interior of said window.

2. The window as recited in claim 1, wherein said frame is provided with a groove in which a projection disposed on said casement member engages, said groove being designed to guide said casement member and said pivotal member when said casement member is pivoted away from said pivotal member.

3. The window of claim 1, wherein said protective cladding has a projecting portion extending toward a window pane fitted in said casement member.

4. The window of claim 3, wherein said projecting portion has on its edge facing said window pane, a sealing strip sealing against said window pane.

5. A window comprising a frame member; a casement member; said casement member having two part-casement members interconnected by hinge means; one exteriorly disposed structural, pivotal member; first pivot means connecting an edge portion of said pivotal member to said frame member; second pivot means connecting an opposite edge portion of said pivotal member to an adjacent edge portion of said casement member; said pivotal member being a protective cladding covering at least an exterior side of said casement member; said hinge means connecting said part-casement members and being located at the edges of the part-casement member adjacent said second pivot means; said protective cladding and said casement member having, at their side edges adjacent said first pivot means, cooperating locking means to selectively lock the cladding and the casement member together to pivot as a rigid unit about said first pivot means and to pivot away from each other about said second pivot means when said protective cladding is pivoted away from said frame member, whereby said part-casement members may be pivoted to positions where both sides thereof are accessible from a location interior of said window.

6. The window of claim 5, wherein said protective cladding has a projecting portion extending toward a window pane fitted in said casement member.

7. The window of claim 6, wherein said projecting portion has on its edge facing said window pane a sealing strip sealing against said window pane.

* * * * *